US007571680B1

(12) United States Patent
Tafoya

(10) Patent No.: US 7,571,680 B1
(45) Date of Patent: Aug. 11, 2009

(54) ORDNANCE CANISTER WITH COLLAPSIBLE FUEL-STORING STRUCTURE THAT AFTER DESCENT AND IMPACT ATOMIZES AND FORCEFULLY DISPERSES FUEL

(76) Inventor: Samuel Barran Tafoya, 135 41st St., Bradenton, FL (US) 34208

( * ) Notice: Subject to any disclaimer, the term of this patent is extended or adjusted under 35 U.S.C. 154(b) by 598 days.

(21) Appl. No.: 11/515,699

(22) Filed: Sep. 5, 2006

(51) Int. Cl.
*F42B 10/00* (2006.01)

(52) U.S. Cl. ..... 102/364; 102/365; 102/363; 102/334; 102/369

(58) Field of Classification Search ..... 102/363–370, 102/334, 382
See application file for complete search history.

(56) References Cited

U.S. PATENT DOCUMENTS 1,305,751 A * 6/1919 Stearns ..... 102/365
1,554,827 A * 9/1925 Pass ..... 102/365
1,671,364 A * 5/1928 Gangnes ..... 102/370
2,354,882 A * 8/1944 Samann ..... 102/365
2,509,244 A * 5/1950 Nicholas ..... 102/365
2,509,710 A * 5/1950 Van Loenen ..... 102/365
3,961,579 A * 6/1976 Faber et al. ..... 102/364
4,195,572 A * 4/1980 Knapp ..... 102/367
4,353,303 A * 10/1982 Bell ..... 102/367
4,436,036 A * 3/1984 Bell ..... 102/367
4,667,601 A * 5/1987 Diamond et al. ..... 102/368
5,094,168 A * 3/1992 Rumer ..... 102/334
6,209,461 B1 * 4/2001 Riffet et al. ..... 102/513

* cited by examiner

*Primary Examiner*—Michelle (Shelley) Clement
(74) *Attorney, Agent, or Firm*—Dorothy S. Morse

(57) ABSTRACT

A fuel-storing ordnance canister for release from military aircraft that does not explode upon impact, its collapsible accordion-like structure instead forcefully dispersing atomized fuel in an upwardly direction in the impact zone after descent for dispersal in, around, and beyond the impact zone. When the fuel from multiple canisters is released into a drop zone and later ignited by a dropped or ground-based incendiary device, all life in the dispersal area is eliminated. Tail fins assure nose-down flight and provide handles for easy canister handling and loading onto airplanes. The configuration of a pop-open tail plug allows for its partial release upon canister collapse to create a spray nozzle that atomizes the fuel stored in the canister as it is being dispersed. The most preferred application is by the U.S. Military to eliminate terrorists hiding in caves, hidden ordnance, and other areas previously resistant to air-released ordnance.

20 Claims, 5 Drawing Sheets

ORDNANCE CANISTER WITH COLLAPSIBLE FUEL-STORING STRUCTURE THAT AFTER DESCENT AND IMPACT ATOMIZES AND FORCEFULLY DISPERSES FUEL

CROSS-RELATED APPLICATIONS

None.

BACKGROUND FIELD OF INVENTION

This invention relates to ordnance dropped from military aircraft, specifically to a fuel-storing ordnance canister configured for release from military aircraft that does not explode upon impact. Instead, its collapsible accordion-like structure forcefully atomizes and disperses the stored fuel in an upwardly direction in the impact zone after descent for dispersal in, around, and beyond the impact zone. When the stored fuel from multiple canisters is released into a drop zone and later ignited by a dropped or ground-based incendiary device or devices, all life in the dispersal area is eliminated. If not burned, the fuel vapors in the dispersal area at a minimum will deprive the oxygen needed for life and suffocation will occur. Tail fins assure nose-down flight and provide handles for the easy loading of the canisters onto airplanes. Further, the configuration of a pop-open tail plug allows for its partial-release upon canister collapse to create a venturi spray nozzle that atomizes the fuel stored in the canister as it is being forcefully sprayed to create a wider dispersal area that would otherwise occur. The most preferred application is by the U.S. Military to eliminate terrorists hiding in caves, hidden arsenals, and other areas previously resistant to air-released ordnance.

BACKGROUND DESCRIPTION OF THE RELATED ART

Terrorists have learned to hide in caves and in hilly terrain for protection against impact-detonated ordnance dropped from airplanes. They are also known to hide people and ordnance in underground bunkers that are unaffected, or no more than minimally affected, by such impact-detonated ordnance. To reach them and put a stop to their terrorist activities, ordnance is needed that can reach beyond its immediate impact zone and gain entry into the caves and underground bunkers where the terrorists hide. The present invention is a device that can do so by employing the hilly terrain itself, when present, and the force of gravity to advantage for widespread dispersal of the fuel it carries beyond the immediate impact zone. This is possible since the present invention is a device that does not explode upon impact in the manner of other ordnance dropped from airplanes. Instead, it stores fuel and then as its pleated accordion-like canister collapses upon impact, the stored fuel is atomized as it is forcefully sprayed in an upwardly direction in and around an impact area. Then, assisted by gravity, windy weather conditions, and delayed ignition, the atomized fuel has time for airborne dispersal beyond the immediate drop zone and penetration into areas that previously dropped ordnance could not reach, such as caves and underground bunkers that are more substantially constructed for resistance to impact-detonated ordnance. It can also destroy hidden ordnance arsenals and is lighter to transport and lower in cost to make and use than the heavy metal-clad impact-detonated ordnance currently in use. No invention is known that has all of the features and advantages of the present invention.

SUMMARY OF THE INVENTION

Objectives and Advantages

It is the primary object of the present invention to provide a means for the U.S. military to reach and eliminate terrorist threats by using ordnance dropped from military aircraft that does not explode upon impact, but instead provides atomizes fuel that is forcefully sprayed from a canister for airborne dispersal that has the opportunity for delayed ignition after reaching terrorists in caves, hidden ordnance, underground bunkers, and other areas previously resistant to impact-detonated ordnance. It is also an object of the present invention to provide delayed-ignition ordnance capable of being dropped from military aircraft that has a low manufacturing cost when compared to ordnance configured for impact detonation after descent. It is a further object of the present invention to provide delayed-ignition ordnance capable of being dropped from military aircraft that does not require any special storage or handling requirements before or during flight, and can be stored as easily as the plastic gasoline cans commonly used by motorists for their automobiles, trucks, motorcycles, and ATV's. It is also an object of this invention to provide delayed-ignition ordnance capable of being dropped from military aircraft that is reliably configured for nose-down flight for maximum dispersal of fuel in and beyond the impact zone. It is further an object of the present invention to provide delayed-ignition ordnance capable of being dropped form military aircraft that is easy to handle and load onto airplanes. It is also an object of this invention to provide delayed-ignition ordnance capable of being dropped from military aircraft that greatly reduces the ground fire risk to the transporting airplane that is present with ordnance configured for impact detonation.

The present invention, when properly made and used, provides delayed-ignition ordnance intended for being dropped from military aircraft into an impact zone whereby widespread dispersal of the fuel it carries typically occurs before it is ignited by a dropped or ground-based ignition source. Many present invention devices are typically dropped at once to create a conflagration on the ground when the dispersed fuel previously stored in them is ignited. In the alternative, if not burned, the fuel vapors in the dispersal area at a minimum will deprive the oxygen needed for life and suffocation will occur. Each present invention device stores fuel capable of being atomized once impact occurs and carries no explosive detonating device, thus greatly reducing the potentially adverse consequence of ground fire to the transporting airplane that is present when impact-detonated ordnance is carried. Thus, the risk to military aircraft is no more adverse than from the fuel it stores for its own flight capability, as airplanes carry fire extinguishers and the crew has time to eject, whereas when ground fire hits impact-detonated ordnance the resulting explosion is instantaneous leaving no time to save the crew. Each present invention device is configured with a collapsing fuel-storing canister having pleated accordion-like sides, multiple tail fins that assure a nose-down flight, a tail fill/exit opening configured for prompt and easy fuel entry into and exit from the canister, and a tail plug configured to block the tail opening prior to canister impact and then partial release from the canister upon impact to form a venturi with the tail opening that causes atomization and forceful spraying of fuel in an upwardly direction in, around, and beyond the canister's impact zone. Depending upon the amount of time elapsing prior to fuel ignition and the amount of added assistance from gravity and/or windy weather conditions for airborne fuel dispersal, the atomized fuel can have the opportunity to reach terrorists in caves, hidden ordnance, underground bunkers, and other areas previously resistant to the deteriorating effects of ordnance configured for localized impact detonation. Although an incendiary device can be associated with or dropped simultaneously with the present invention ordnance, any dropped incendiary device should be at the end of any delayed-ignition ordnance release to allow for widespread/maximum fuel dispersal before it is burned. In the alternative, the burning of atomized fuel from the present invention can also be initiated by one or more sources located in or around the impact zone, such as but not limited to a lit cigar or cigarette, a fire, an open flame, or a spark. In addition, although size is not considered a limitation, it is preferred for the present invention canisters to each contain approximately five gallons of fuel for ease in personnel handling and loading of canisters onto airplanes, as well as more stability while in flight. Further, storage of present invention canisters is preferably in a nose-down position, with a nose ring helping to attain and maintain a stable nose-down storage position during flight, wherein upwardly and outwardly extending tail fins are easily accessible for use as handles for manual canister transport and loading onto airplanes. Compact storage of present invention canisters is also possible, since they can be touching with tail fins in adjacent canisters positioned to clear one another. Manufacturing of the present invention collapsing-canister ordnance can be from injection-molded plastic and therefore its cost is significantly lower than the cost of the heavy metal-encased impact-detonated ordnance previously dropped from airplanes. Cost of the present invention is further lowered by the use of low octane fuel, which flashes into flame faster than the slow burning higher octane fuels. Storage of the present invention canisters is as easy as that used for the plastic fuel cans commonly employed by motorists to provide gasoline to their automobiles, trucks, motorcycles, and ATV's.

For most effective and efficient operation and the widest possible dispersal of fuel in, around, and beyond its impact zone, nose-down flight of the present invention is required. Upon impact, the pleated and accordion-like sides of the present invention canister collapse nose-to-tail, elevating the pressure of air trapped in a pocket located in the canister's tail section around the fuel fill/exit opening, which also prevents overfill of fuel in the canister. The pleated and accordion-like sides of the present invention canister are also used so that the canister can accommodate the expansion of gasoline that occurs in the low atmospheres at the high altitudes prior the canister being dropped from military aircraft into an impact zone, without any fear or risk of the canister breaking, cracking, or leaking. The tail plug is preferably seated in its fuel dispersal-blocking position within the fuel fill/exit opening by multiple large primary barbs, and also by multiple smaller/weaker secondary barbs, that are both sufficiently flexible for laying down against grooves in the tail plug body during twisted insertion of the tail plug into the canister's fuel fill/exit opening, and then regaining their original extended positions after complete tail plug insertion into the fuel fill/exit opening, whereby they again become outwardly extended from the tail body. The elevated air pressure and resulting failure of the smaller/weaker secondary barbs on the tail plug, cause it to become partially ejected from the canister and held only by the stronger primary barbs in a manner that creates a venture spray nozzle, which in combination with the tapered portion of the canister around the fuel fill/exit opening causes the fuel traveling through the venturi opening to become atomized and forcefully sprayed in an upwardly direction for airborne dispersal in the impact zone and beyond it. The igniter for the atomized fuel could be a simple device or devices associated with one or more of the released canisters, or dropped independently from them. However, if dropped ignition is used, it should be associated with the last present invention canister or canisters released. In the alternative, ground-based ignition can be used if one or more ignition sources are known to be present on the ground in or around the impact area Once the present invention is dropped from military aircraft and its atomized and dispersed fuel is ignited, no trace of its canister, tail fins, or tail plug will be found as conflagration will completely consume them. Nothing in or beyond its drop zone in the fuel dispersal area will escape the effects of the present invention when multiple present invention devices are released to fully cover an area to engulf it in flames. Any life within its reach will be fully destroyed by burning or suffocation. Avoiding the use of metal in the present invention make them lighter in weight, less expensive to make and use than metal-clad impact-detonated ordnance, and their preferred plastic canisters can not be detected by radar during their downward flight.

The description herein provides preferred embodiments of the present invention but should not be construed as limiting its scope. For example, variations in the number of pleats in each side of the present invention canisters; the size of the tail plug; the length and thickness dimensions of the tail fins; the fuel-holding capacity of each canister; and the size and number of primary and secondary barbs used on each tail plug; other than those shown and described herein, may be incorporated into the present invention. Thus, the scope of the present invention should be determined by the appended claims and their legal equivalents, rather than being limited to the examples given herein.

DETAILED DESCRIPTION OF THE INVENTION

Figure 1:
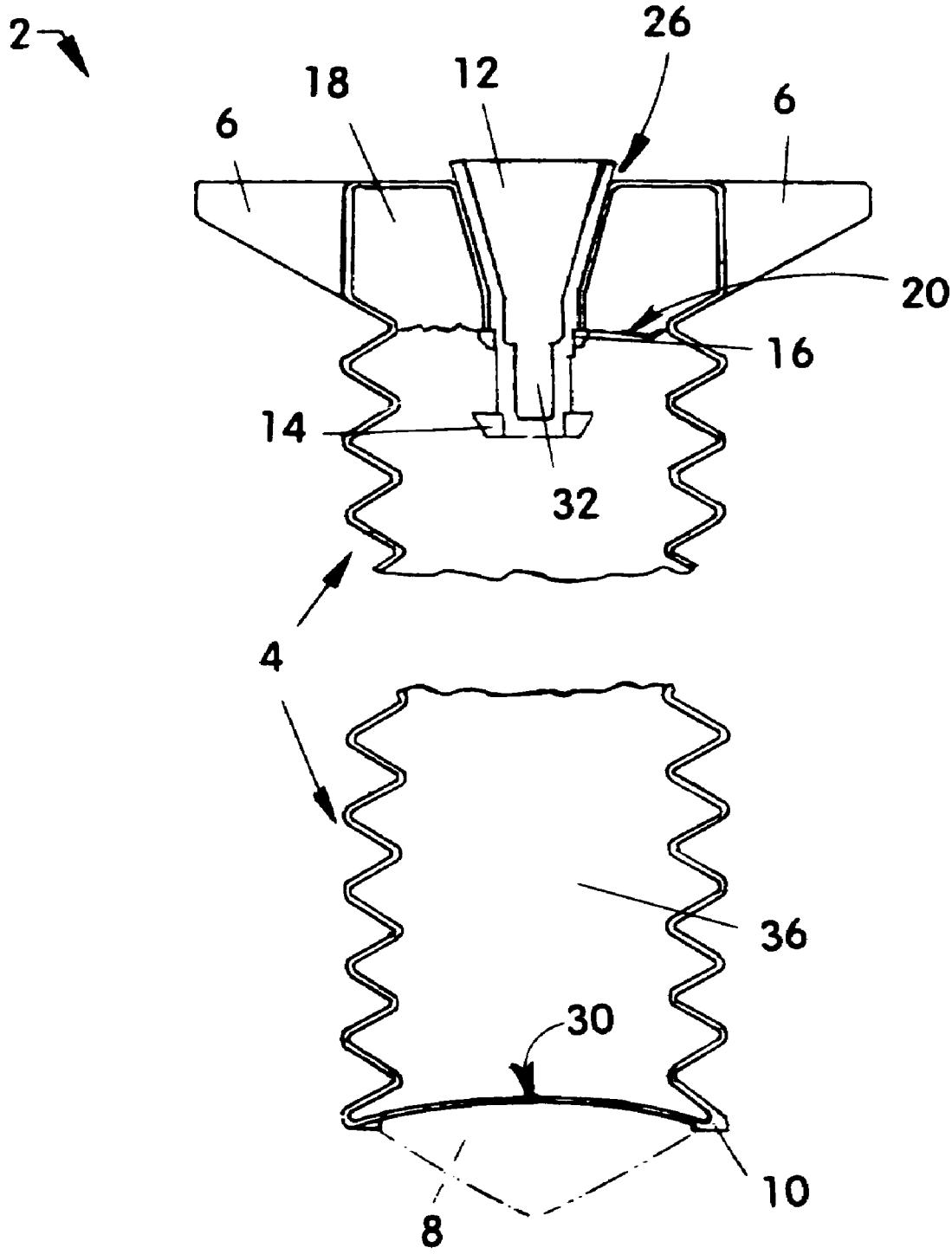
FIG. 1 is a sectional side view of the most preferred embodiment of the present invention having a canister with pleated accordion-like sides configured for collapse nose-to-tail, a concave nose configuration that creates an invisible nose cone for enhanced stability during flight and easier nose-down storage, multiple tail fins extending beyond the accordion-like sides and configured for use as handles to facilitate transport and storage, a tail fill/exit opening for fuel addition and its exit after canister impact and nose-to-tail canister collapse, a hollow interior used for fuel storage, a sealing tail plug with a tapered configuration and two sets of barbs, and a pocket adjacent to the tail plug for the storage of air that prevents overfilling of the canister with fuel and which is pressurized upon the nose-to-tail canister collapse after impact that forces the tail plug into its partially-released position and creation of a venturi nozzle that causes forceful spraying and widespread dispersal of atomized fuel into, around, and beyond the impact zone.

The present invention provides delayed-ignition ordnance intended for being dropped by military aircraft (not shown) into an impact zone. Many present invention devices are typically dropped successively to create a conflagration on the ground when the dispersed fuel (identified by the number 34 in FIG. 4) previously stored in them is eventually ignited. Each present invention device stores fuel 34 capable of being atomized for airborne dispersal once impact occurs and carries no explosive detonating device, thus greatly reducing the risk of ground fire to the transporting airplane that is present with impact-detonated ordnance. Instead, each present invention device is configured with a nose-to-tail collapsing fuel-storing canister 2 having pleated accordion-like sides 4, multiple tail fins 6 that assure a stable nose-down flight, a tail fuel fill/exit opening 26 configured for prompt and easy fuel 34 entry into and exit from canister 2, and a tail plug 12 configured to block tail fill/exit opening 26 prior to canister 2 impact and then partial release of fuel 34 from canister 2 upon its impact after descent to form a venturi nozzle with tail opening 26 that causes atomization and forceful spraying of fuel 34 in an upwardly direction in, around, and beyond its impact zone. Depending upon the amount of time elapsed prior to fuel 34 ignition and the amount of added assistance from gravity and/or windy weather conditions, the atomized fuel 34 can have the opportunity to reach terrorists in caves, hidden ordnance, underground bunkers, and other areas previously resistant to impact-detonated ordnance. Although an airborne incendiary device or devices (not shown) can be attached to or separately dropped with present invention ordnance, it should be dropped at the end of the ordnance release to allow the maximum possible airborne dispersal time for atomized fuel 34. Burning of the atomized fuel 34 can also be initiated by one or more sources located in or around the impact zone, such as but not limited to a lit cigar or cigarette, a fire, open flame, or a spark. In addition, although size is not considered a limitation, it is preferred for the present invention canisters 2 to each contain approximately five gallons of fuel 34, and weight less than fifty pounds, for easy personnel handling and loading onto airplanes. If canisters 2 are too tall, they may bend during descent and become unwieldy and/or produce wobbly flight that could result in less than maximum dispersal fuel after impact. Also, taller and larger canisters are not easily picked up, carried for loading on airplanes, or otherwise handled. Further, storage of present invention canisters 2 is preferably in a nose-down position, with a nose ring 10 helping to attain and maintain a stable nose-down storage position, wherein upwardly extending tail fins 6 are easily accessible for use as handles for manual canister 2 transport and loading onto airplanes. Manufacturing of the present invention collapsing-canister ordnance can be from injection-molded plastic and its cost is low when compared to the cost of the heavy metal-encased impact-detonated ordnance previously dropped from airplanes. Cost of the present invention is further lowered by the use of low octane fuel, which flashes into flame faster than the slow burning higher octane fuels. Storage of the present invention canisters is as easy as that used for the plastic fuel cans commonly employed by motorists to provide gasoline to their automobiles, trucks, motorcycles, and ATV's.

For most effective and efficient operation and maximum dispersal of atomized fuel 34 in and beyond an impact area, nose-down flight of the present invention canister 2 is required. Upon impact, the pleated and accordion-like sides 4 of the present invention canister 2 collapse nose-to-tail, elevating the pressure of air in stored in an air pocket 18 located in the canister's tail section, which also prevents overfill of fuel 34 in canister 2. The tail plug 12 is seated in its fuel blocking position by multiple large primary barbs 14 and multiple smaller/weaker secondary barbs 16 that are both sufficiently flexible for laying down against grooves 22 in the body of tail plug 12 during twisted insertion of tail plug 12 into the fuel fill/exit opening 26 of the present invention canister 2, and then regaining their original extended configuration whereby barbs 14 and 16 are again outwardly extended from the body of tail plug 12. The elevated air pressure and resulting failure of the smaller/weaker secondary barbs 16 on tail plug 12 cause it to become partially ejected from canister 2 in a manner that creates a venture nozzle, which in combination with the tapered portion of canister 2 around the fuel fill/exit opening 26 causes the fuel 34 to become atomized and forcefully sprayed in an upwardly directions for dispersal in and around the impact zone, and also possible airborne dispersal beyond the impact zone. The igniter (not shown) for the atomized fuel 34 could be a simple device or devices associated with one or more of the released canisters 2, a device or devices dropped separately with canisters 2, however, if one or more dropped igniters are used, they should be associated with the last canister or canisters 2 released for maximum fuel 34 dispersal prior to ignition. In the alternative, the igniter can be one or more sources known to be present on the ground in or around the impact area, such as a lit cigar or cigarette, a fire, an open flame, or a spark.

Figure 2:
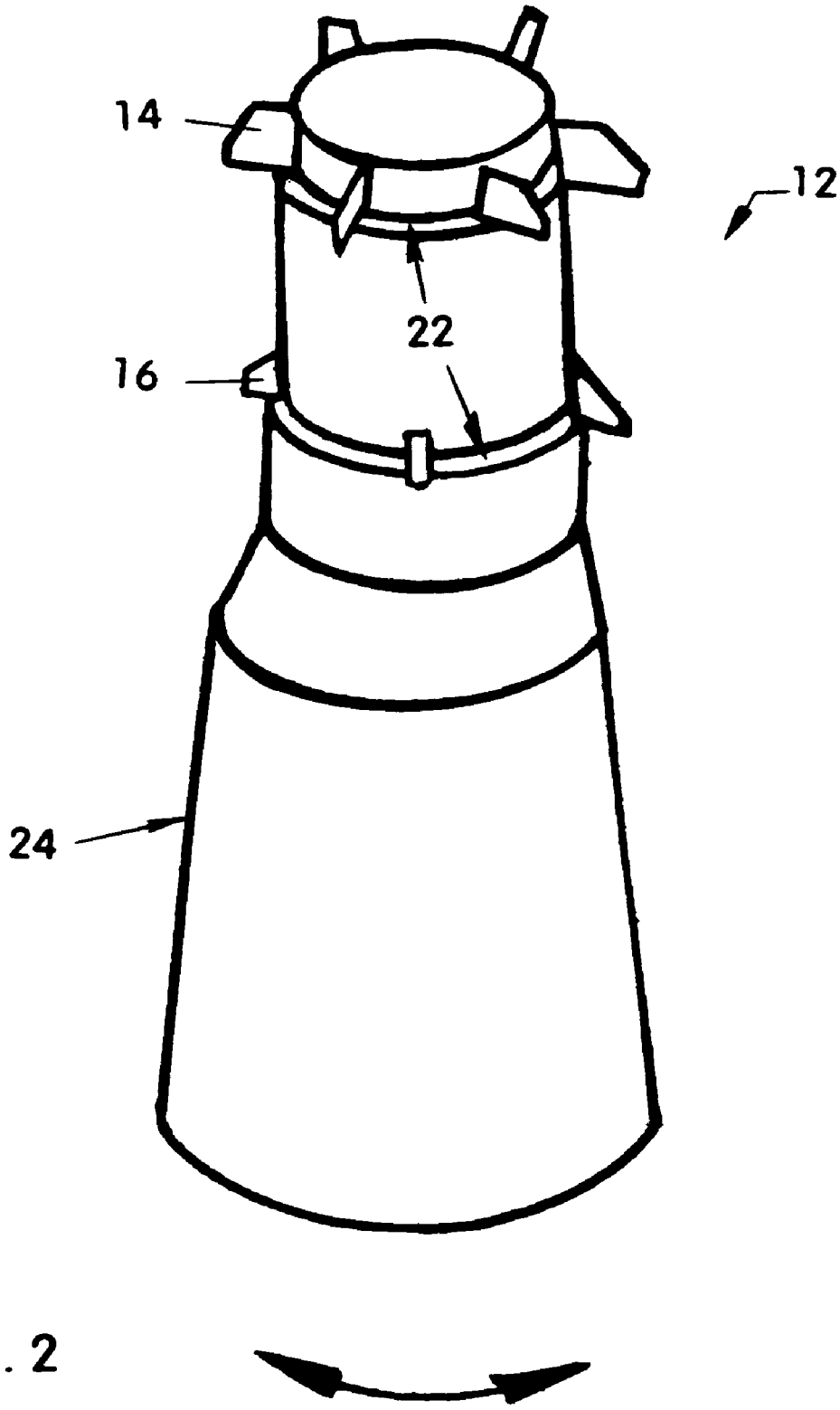
FIG. 2 is an enlarged perspective view of the tail plug in the most preferred embodiment of the present invention with its larger primary barbs that prevent full release of the tail plug from the canister after impact, its smaller and weaker secondary barbs that allow for partial release of the tail plug from the canister after impact, and the grooves that assist in twisting insertion of the tail plug into the canister's fuel fill/exit opening for sealing fuel in the canister during transport and storage prior to use and complete removal of the tail plug from the canister for fuel loading.
Figure 3:
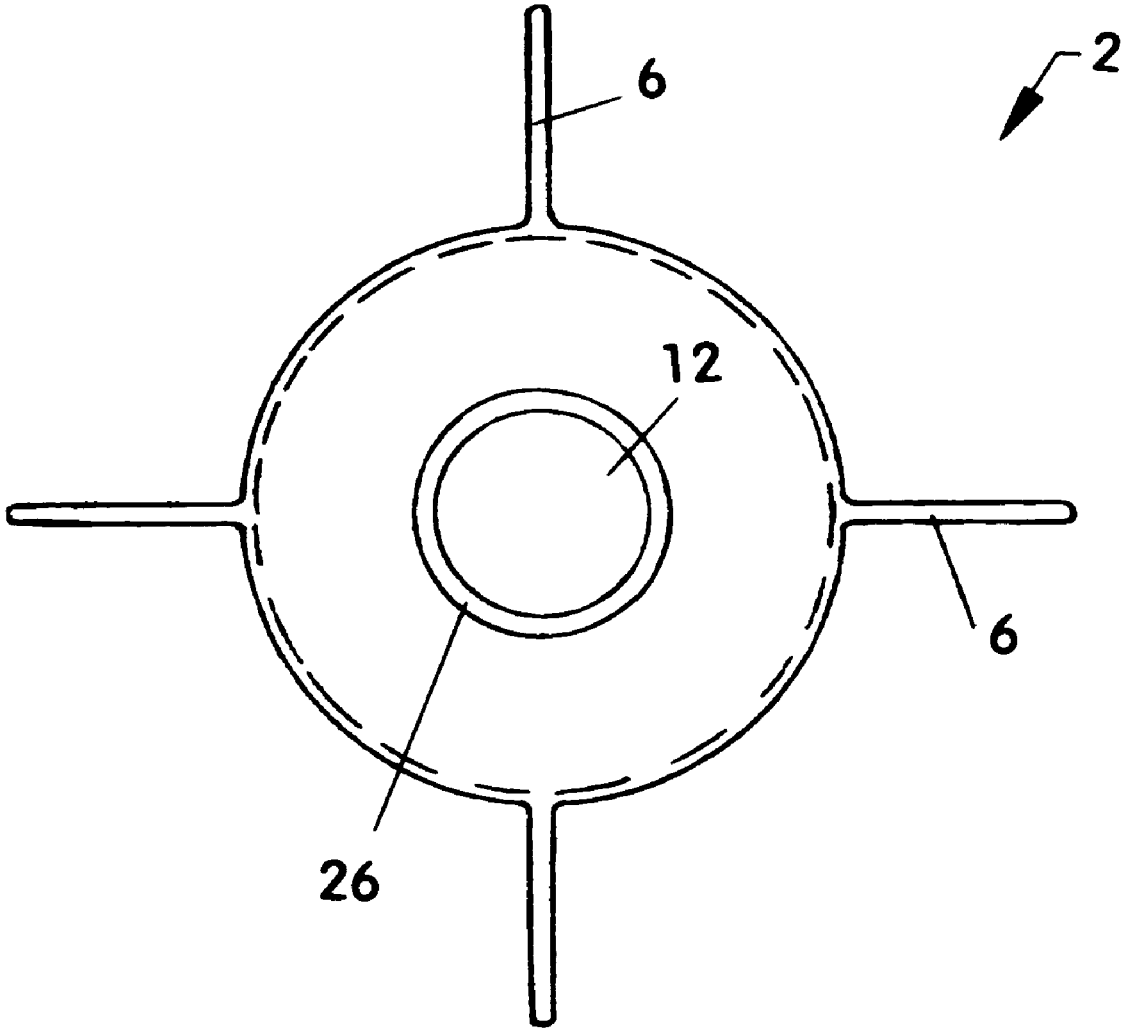
FIG. 3 is tail end view of the canister in the most preferred embodiment of the present invention, its four tail fins, and a centrally-positioned fuel-sealing tail plug.
Figure 4:
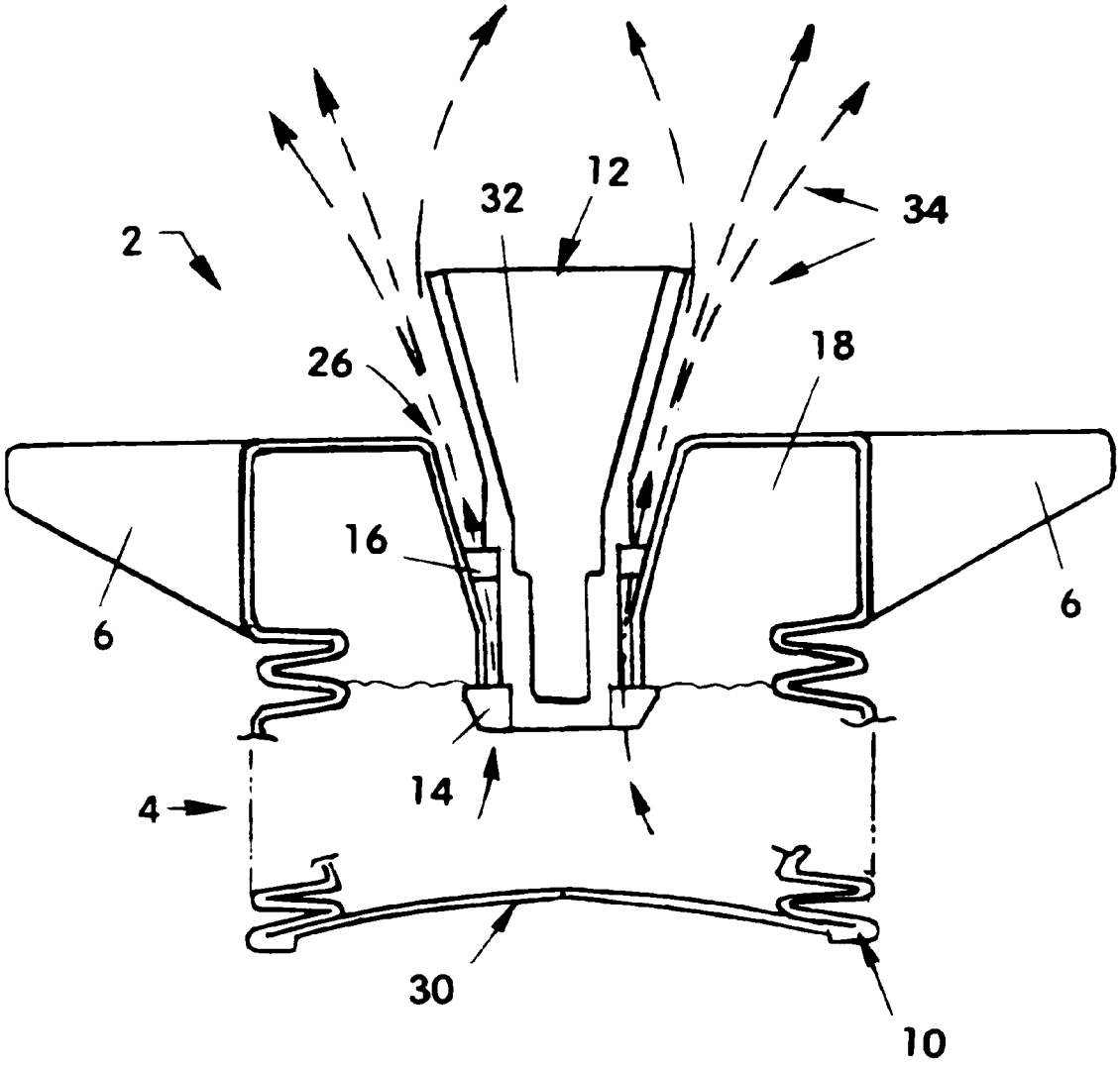
FIG. 4 is an enlarged sectional side view of the canister in the most preferred embodiment of the present invention with its tail plug in a partially-released position against the canister fuel fill/exit opening and held in place only by the primary barbs, with the pleated sides of the canister in at least a partially collapsed state, and further with arrows showing fuel being forcefully ejected from the fuel fill/exit opening in an upwardly direction.
Figure 5:
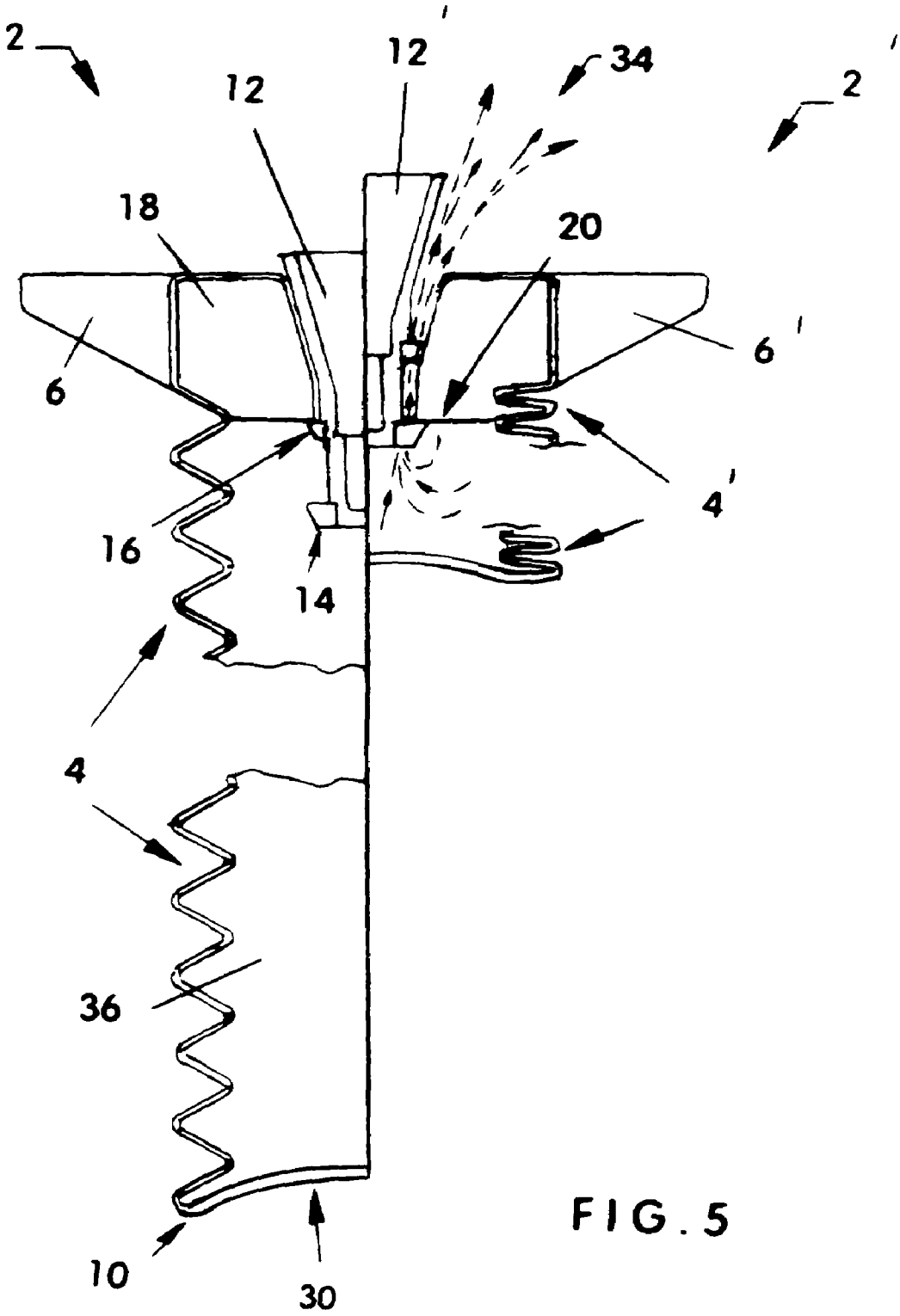
FIG. 5 is a sectional view of a canister in the most preferred embodiment of the present invention shown in two positions, with the left side showing the canister before descent and impact in an expanded and sealed state, and with the right side showing the canister in a collapsed state and dispersing fuel.

FIGS. 1-5 illustrate the most preferred embodiment of the present invention, preferably formed from plastic via injection molding. FIG. 1 shows a sectional side view of the present invention having a canister 2 with pleated, accordion-like sides 4, an invisible nose cone 8 for enhanced stability during flight and easier nose-down storage, multiple tail fins 6, and a tail plug 12 with a tapered configuration and two sets of barbs 14 and 16. FIG. 2 shows an enlarged perspective view of the tail plug 12 having two sets of barbs 14 and 16 and grooves 22 into which barbs 14 and 16 are laid down during twisted insertion of tail plug 12 into the fuel fill/exit tail opening 26 of canister 2. FIG. 3 shows the tail end of canister 2, multiple tail fins 6 that assure nose-down flight, and the centrally-located tail plug 12 that blocks fuel 34 exit from canister 2 prior to its impact and is partially released for forceful spraying of atomized fuel that can be subject to further airborne dispersal. FIG. 4 illustrates canister 2 with tail plug 12 in a partially-released position and with the pleated sides 4 of canister 2 in at least a partially-collapsed state, and further with arrows showing fuel 34 being forcefully ejected as a conical spray from fuel fill/exit opening 26 in an upward direction. FIG. 5 shows a canister in the most preferred embodiment of the present invention in two positions, with the left side representing the canister before descent and impact in an expanded and sealed state, and with the right side representing the canister in a collapsed state and dispersing fuel.

FIG. 1 shows the most preferred embodiment of the present invention having a canister 2 with pleated accordion-like sides 4 configured for collapse nose-to-tail. The accordion-like shape has two purposes, for strength when canister 2 is full of fuel 34 and also to facilitate canister 2 collapse nose-to-tail when it hits the ground after descent from military aircraft. It is the weight of fuel 34 that causes the canister 2 collapse. The number of pleats in accordion-like sides 4, as well as their configuration and spacing, are not critical as long as the structure used facilitates nose-to-tail collapse of canister 2. The present invention also has a concave nose configuration 30 that creates an invisible nose cone 8 for enhanced stability during flight at any speed and easier nose-down storage when a stability-enhancing nose ring 10 encircles it. The concave nose configuration 30 strengthens canister 2 while it is loaded with fuel 34 and prevents oil canning of the bottom surface of canister 2. FIG. 1 also shows multiple tail fins 6 extending beyond the accordion-like sides 4 and configured for use as handles for moving canisters 2 onto pallets for bulk loading into airplanes. The concave nose configuration 30 and nose ring 10 allow canisters 2 to touch one another during storage, as long as tail fins 6 oriented to avoid one another. Although four tail fins 6 are shown, and four are preferred for low cost manufacturing considerations, the use of four tail fins 6 is not critical for transport, storage, or downward flight. In addition, FIG. 1 shows a tail fill/exit opening 26 for fuel 34 loading and its exit after canister 2 impact, as well as a hollow interior 36 used for fuel 34 storage, a maximum fuel fill line 20, a sealing tail plug 12 with a tapered configuration and two sets of barbs 14 and 16, and a pocket 18 adjacent to tail plug 12 for air that prevents overfilling of canister 2 with fuel 34 and which is pressurized upon the nose-to-tail canister 2 collapse after impact that forces tail plug 12 into its partially-released position and to create a venturi nozzle that causes forceful upward conical spraying of atomized fuel 34 and results in the airborne dispersal of fuel 34 in, around, and beyond the impact zone. The size of air pocket 18 is not limited to that shown in FIG. 1, and can be different as long as it remains sufficiently large to cause the needed partial-release of tail plug 12 that leads to the conical and upwardly directed spray of fuel 34 in and around the canister's 2 impact area. To insert tail plug 12 into its sealed position, although not limited thereto, a ram rod (not shown) can be used to forced into opening 26, or optionally tail plug 12 can have a cavity 32 therein into which a tool (not shown) can be inserted to facilitate the twisting insertion and tightening of tail plug 12 within fuel fill/exit opening 26. A twisting insertion of tail plug 12 into opening 26 is preferred to achieve the most secure and reliable sealing of opening 26, wherein primary barbs 14 and secondary barbs 16 have the opportunity to regain their original extended positions after laying down in an undamaged orientation against grooves 22. As shown in FIG. 1, once tail plug 12 is in its usable position, it is preferred that a minimal amount of tail plug 12 extend beyond canister 2. Thus, once tail plug 12 is seated within opening 26, it is contemplated that a tool would be needed to remove it. In addition, FIG. 1 shows the barbs 14 and 16 used to seal tail plug 12 within opening 26 and permit the partially-released positioning of tail plug 12 that creates a venturi nozzle. Although the number, size, positioning, and spacing of primary barbs 14 and secondary barbs 16 are not critical or limited to that shown in FIG. 1 as long as they fulfill their intended function, barbs 14 and 16 must be made from flexible material that allows then to lay down against grooves 22 during twisted insertion of tail plug 12 into opening 26 to seal it, and then allows barbs 14 and 16 to regain their original extended configurations once tail plug 12 is in its desired position of use. While six primary barbs 14 and four secondary barbs 16 are shown in FIG. 1 and preferred, and the use of larger and more numerous primary barbs 14 is also preferred when compared to the dimension and number of secondary barbs 16, primary barbs 14 and secondary barbs 16 with less physical difference and number variation can also be used as long as secure sealing of opening 26 is achieved when tail plug 12 seals it and the collapse of canister 2 places tail plug 12 into the needed partially-released position that creates a venturi nozzle. The configuration of tail plug 12 and opening 26 may also be different from that shown. However, it is still contemplated for both to have a tapering configuration that permits a prompt partial-release of tail plug 12 upon canister 2 collapse to create the needed venturi nozzle.

FIG. 2 shows tail plug 34 in the most preferred embodiment of the present invention with its larger primary barbs 14 that prevent full release of tail plug 12 from canister 2 after impact, its smaller and weaker secondary barbs 16 that allow for partial release of tail plug 12 from canister 2 after impact, and the grooves 22 that accommodate the laying down of barbs 14 and 16 to assist in twisting insertion of tail plug 12 into canister 2 for sealing fuel 34 therein and complete removal of tail plug 12 from canister 2 for the addition of fuel 34. Central position of tail plug within canister 2 is critical for even dispersal of fuel 34 at impact. Further, although not critical, four tail fins 6 are preferred for manufacturing convenience and a reduced product cost. The six primary barbs 14 and four secondary barbs 16 shown in FIG. 2 are preferred. Also, when different numbers of barbs 14 and 16 are used, it is generally preferred for primary barbs 14 to be larger and more numerous than secondary barbs 16. However, unlimited variation is number, size, thickness, spacing, and configuration of barbs 14 and 16 can occur as long as secure sealing of opening 26 is achieved when tail plug 12 is properly seated in it, and collapse of canister 2 places the tail plug 12 into the needed partially-released position that creates a venturi spray nozzle for fuel 34. The two-headed arrow indicates the twisting motion preferred for proper insertion/removal of tail plug 12 into opening 26 that permits tail plug 12 to seal opening 26 against fuel 34 leakage during transport, storage, and downward flight from military aircraft. Twisting helps to prevent damage to barbs 14 and 16 after fuel 34 loading so that the needed venturi spray nozzle for fuel 34 is properly achieved after nose-to-tail collapse of canister 2.

FIG. 3 shows the tail end of canister 2 in the most preferred embodiment of the present invention, its four tail fins 6, and a centrally-positioned fuel-sealing tail plug 12. Central positioning of tail plug 12 is considered critical to the maximum dispersal of fuel 34 into the impact area around canister 2. Also, the number of tail fins 6 may be different from that shown in FIG. 3. Further, the relative dimensions of tail fins 6 to canister 2, and both to tail plug 12, may be different from that shown in FIG. 3.

FIG. 4 shows the canister 2 in the most preferred embodiment of the present invention with its tail plug 12 in a partially-released position and the pleated sides 4 of canister 2 in at least a partially collapsed state. Arrows further show fuel 34 being forcefully ejected from the fuel fill/exit opening 26 in an upwardly direction. It is intended for fuel 34 to be forcefully released in a conical array on all sides of tail plug 12 in its partially-released position within opening 26. The air pocket 18 that increases in pressure and causes forceful ejection of tail plug 12 from opening 26, and the maximum fill line for fuel 34 defined by air pocket 18 that prevents fuel 34 overfill, are also illustrated in FIG. 4. FIG. 4 also shows the concave nose configuration 30 and nose ring 10, and further shows phantom lines that indicate the preferred continuous accordion-like pleated body shape 4. The number 32 illustrates a cavity for tool-assisted twisting of tail plug 12 into its seated and fuel-blocking position within fuel fill/exit opening 26. In addition, FIG. 4 shows the larger primary barbs 14 being used to retain tail plug 12 against canister 2 to form a venturi nozzle that forcefully disperses fuel 34. In contrast, in FIGS. 1 and 5, one can see canister 2 loaded with fuel 34 and tail plug 12 being seated in its fuel-blocking position within opening 26 via secondary barbs 16.

FIG. 5 shows a canister 2 in the most preferred embodiment of the present invention shown in two positions, with the left side showing canister 2 before descent and impact in an expanded and sealed state, and with the right side showing canister 2' in a collapsed state and dispersing fuel 34 in an upwardly direction. In the left side of canister 2, fuel 34 is stored in the hollow interior 36 of canister 2, with the accordion-like side structure 4 of canister 2 in its normal expanded state and the secondary barbs 16 retaining tail plug 12 in the preferred position of use to block the exit of fuel 34 from canister 2 through opening 26 and maintain the level of fuel 34 at the approximate maximum fuel fill line 20. The pressure of air in pocket 18 is also stable and unchanging. In the right side of canister 2', fuel 34 is being forcefully sprayed upwardly from the hollow interior 36 of canister 2', as a result of the collapsed pleats of the accordion-like side structure 4' raising the pressure in air pocket 18 and the partial release of tail plug 12' wherein the secondary barbs 16 fail and the primary barbs 14 come into a position to retain tail plug 12 so as to create a venturi nozzle with opening 26 and allow the forceful upward dispersing of fuel 34 from canister 2'. The left and right side of the illustration in FIG. 5 showing canister 2 and 2' respectively also include representations for tail fins 6 and 6'.

I claim:

1. A delayed-ignition ordnance device for dropped-release from military aircraft, which does not explode upon impact, instead forcefully ejecting atomized fuel in an upwardly direction in its impact zone for airborne dispersal in, around, and beyond the impact zone, said device comprising:

a canister having a hollow interior configured for holding liquid fuel, sides with a pleated structure configured for nose-to-tail collapse upon impact after descent from military aircraft, a concave nose configuration adapted for creation of an invisible nose cone to provide enhanced flight stability and stable storage in a tail-up position, and a tail opening configured for easy fuel entry into and forceful fuel exit in an atomized spray from said canister;

a quantity of liquid fuel capable of being atomized;

a pop-open tail plug configured for sealing said tail opening and partial release from said tail opening so as to form a venturi nozzle that atomizes said fuel in said canister as it is forcefully sprayed from said canister in an upwardly direction as said sides of said canister achieve nose-to-tail collapse upon impact after descent; and a plurality of tail fins outwardly extending from said canister in positions remote from said concave nose and configured for stable nose-down flight of said canister wherein once said fuel is forcefully sprayed from said canister, dispersed into and beyond an impact area, and then ignited, the intense heat from its burning eliminates all life in the entire fuel dispersal area into which said fuel has traveled and also can destroy unexploded ordnance in the dispersal area but not necessarily visible within the impact zone.

2. The device of claim 1 wherein said tail fins are configured for use as handles capable of providing for efficient transport and storage of said canister.

3. The device of claim 1 wherein said canister further comprises the capability to ignite said atomized fuel after impact.

4. The device of claim 1 further comprising an air pocket adjacent to said tail opening that is configured to prevent fuel overfill in said canister and also configured upon pressurization of air therein to cause partial release of said tail plug from said tail opening.

5. The device of claim 1 wherein said tail plug further comprises a plurality of larger primary barbs configured to prevent full release of said tail plug from said tail opening and a plurality of smaller secondary barbs configured for failure so as to partially release said tail plug from said tail opening after canister impact.

6. The device of claim 5 wherein said tail plug further comprises at least one groove configured for temporary receipt of said barbs during twisting insertion of said tail plug into said tail opening of said canister.

7. The device of claim 1 wherein said canister is made from injection molding to achieve a lower per unit cost than the currently used heavy metal-clad impact-detonated ordnance.

8. The device of claim 1 wherein said canister is configured for safe and stable storage in a vertically stackable position with other ones of said canisters.

9. The device of claim 1 wherein said canister is configured for prepositioned pallet storage with other ones of said canisters wherein said canisters can be touching with tail fins oriented to clear one another for ease of loading onto airplanes.

10. The device of claim 1 wherein ignition for said fuel is selected from a group consisting of incendiary devices associated with said canister, incendiary devices dropped separately from military aircraft simultaneously with said canister, and ground-based incendiary devices.

11. The device of claim 1 wherein said canister has a maximum fuel storage capacity of approximately five gallons.

12. The device of claim 1 wherein said canister, said tail fins, and said tail plug are consumed by conflagration after ignition.

13. The device of claim 1 wherein said quantity of fuel is lower cost, fast burning, low octane gasoline.

14. The device of claim 1 wherein said canister, said tail fins, and said tail plug are made from materials and otherwise configured to avoid radar detection while in downward flight.

15. The device of claim 1 wherein said fuel reduces the risk of the airplane transporting it from ground fire.

16. A method of making a delayed-ignition ordnance device for dropped-release from military aircraft, which does not explode upon impact, instead forcefully ejecting atomized fuel in an upwardly direction in its impact zone for airborne dispersal in, around, and beyond the impact zone, said method comprising the steps of:

providing a canister having a hollow interior configured for holding liquid fuel, sides with a pleated structure configured for nose-to-tail collapse upon impact after descent from military aircraft, a concave nose configuration adapted for creation of an invisible nose cone to provide enhanced flight stability and stable storage in a tail-up position, and a tail opening configured for easy fuel entry into and forceful fuel exit in an atomized spray from said canister;

also providing a quantity of liquid fuel capable of being atomized, a pop-open tail plug configured for sealing said tail opening and partial release from said tail opening so as to form a venturi nozzle that atomizes said fuel in said canister as it is forcefully sprayed from said canister in an upwardly direction as said sides of said canister achieve nose-to-tail collapse upon impact after descent, and a plurality of tail fins configured for stable nose-down flight of said canister;

adding said quantity of liquid fuel to said canister via said tail opening;

sealing said opening with said tail plug; and positioning said tail fins in an outwardly-extending orientation relative to said canister remotely from said concave nose so that said tail fins assist in stable nose-down flight of said canister during descent prior to impact, wherein once said fuel is forcefully sprayed from said canister after impact and dispersed into, around, and beyond an impact area, and then is ignited, the intense heat from its burning eliminates all life in the entire fuel dispersal area into which said fuel has traveled and also can destroy unexploded ordnance in the dispersal area but not necessarily visible within the impact zone.

17. The method of claim 16 wherein said tail fins are configured for use as handles capable of providing for efficient transport and storage of said canister.

18. The method of claim 16 wherein said canister further comprises an air pocket adjacent to said tail opening that is configured to prevent fuel overfill in said canister and also configured upon pressurization of air therein to cause partial release of said tail plug from said tail opening.

19. The method of claim 16 wherein said tail plug further comprises a plurality of larger primary barbs configured to prevent full release of said tail plug from said tail opening and a plurality of smaller secondary barbs configured for failure so as to partially release said tail plug from said tail opening after canister impact.

20. The method of claim 19 wherein said tail plug further comprises at least one groove configured for temporary receipt of said barbs during twisting insertion of said tail plug into said tail opening of said canister.

* * * * *